US009854953B2

(12) United States Patent
Fan et al.

(10) Patent No.: US 9,854,953 B2
(45) Date of Patent: Jan. 2, 2018

(54) SURFACE CLEANING APPARATUS WITH DEBRIS EJECTOR

(71) Applicant: BISSELL Homecare, Inc., Grand Rapids, MI (US)

(72) Inventors: Jian Gang Fan, Shenzhen (CN); Jin Yang, Shenzhen (CN)

(73) Assignee: BISSELL Homecare, Inc., Grand Rapids, MI (US)

( * ) Notice: Subject to any disclaimer, the term of this patent is extended or adjusted under 35 U.S.C. 154(b) by 0 days.

(21) Appl. No.: 15/606,066

(22) Filed: May 26, 2017

(65) Prior Publication Data

US 2017/0258285 A1 Sep. 14, 2017

Related U.S. Application Data

(63) Continuation of application No. 14/973,844, filed on Dec. 18, 2015, now Pat. No. 9,687,128.

(60) Provisional application No. 62/097,699, filed on Dec. 30, 2014.

(51) Int. Cl.

| | |
|---|---|
| ***A47L 9/20*** | (2006.01) |
| ***A47L 9/10*** | (2006.01) |
| ***A47L 11/26*** | (2006.01) |
| ***A47L 11/40*** | (2006.01) |
| ***A47L 13/22*** | (2006.01) |
| *A47L 9/14* | (2006.01) |
| *A47L 9/16* | (2006.01) |

(52) U.S. Cl.

CPC ..... *A47L 9/106* (2013.01); *A47L 11/26* (2013.01); *A47L 11/4025* (2013.01); *A47L 13/225* (2013.01); *A47L 9/149* (2013.01); *A47L 9/1608* (2013.01); *A47L 9/20* (2013.01)

(58) Field of Classification Search

CPC . A47L 9/20; A47L 9/106; A47L 9/149; A47L 9/1608; A47L 11/26; A47L 11/4025; A47L 13/225

USPC ..... 15/352

IPC ..... A47L 9/20

See application file for complete search history.

(56) References Cited

U.S. PATENT DOCUMENTS

| | | | | |
|---|---|---|---|---|
| 2,714,426 | A | 8/1955 | Hoover | |
| 5,603,740 | A * | 2/1997 | Roy | A47L 9/20 15/352 |
| 6,625,845 | B2 | 9/2003 | Matsumoto et al | |
| 7,547,340 | B2 | 6/2009 | Park | |
| 2014/0537761 | | 8/2014 | Holz | |

FOREIGN PATENT DOCUMENTS

| | | | |
|---|---|---|---|
| JP | 54051260 | A | 4/1979 |
| JP | 2007061467 | A | 3/2007 |

* cited by examiner

*Primary Examiner* — David Redding
(74) *Attorney, Agent, or Firm* — McGarry Bair PC

(57) ABSTRACT

A surface cleaning apparatus includes a separating and collection assembly defining a collection chamber which receives debris and has a debris outlet, and a debris ejector reciprocally moveable within the collection chamber for vertical displacement relative to an exhaust grill. A push rod can be used to displace the debris ejector relative to the exhaust grill.

20 Claims, 9 Drawing Sheets

SURFACE CLEANING APPARATUS WITH DEBRIS EJECTOR

CROSS REFERENCE TO RELATED APPLICATION

This application is a continuation of U.S. patent application Ser. No. 14/973,844, filed Dec. 18, 2015, which claims the benefit of U.S. Provisional Patent Application No. 62/097,699, filed Dec. 30, 2014, both of which are incorporated herein by reference in their entirety.

BACKGROUND OF THE INVENTION

Surface cleaning apparatuses, such as vacuum cleaners are configured for cleaning a wide variety of common household surfaces such as bare flooring, including tile, hardwood, laminate, vinyl, and linoleum, as well as carpets, rugs, countertops, stove tops and the like. Vacuum cleaners have a suction source for generating a suction force at a nozzle in contact with the surface to be cleaned, and a system for separating and collecting debris (which may include dirt, dust, hair, and other debris) from a working airstream for later disposal. Typical systems include cyclonic separation systems, centrifugal separation systems, bulk separation systems, or filter bag systems. For non-bag systems, the collection system includes a unit or module in which debris is collected and that is removed from the vacuum cleaner for emptying collected debris.

BRIEF DESCRIPTION OF THE INVENTION

According to one aspect of the invention, a surface cleaning apparatus includes a separating and collection assembly having a housing defining a collection chamber adapted to receive debris and having a debris outlet at a lower end thereof, a door at a lower end of the housing selectively closing the debris outlet, an exhaust grill within the housing, a debris ejector reciprocally moveable within the housing, and a push rod operably coupled to the debris ejector. The debris ejector comprises an ejector plate adapted for vertical displacement relative to the exhaust grill and comprises an opening accommodating the exhaust grill. The ejector plate passes in proximity to the exhaust grill in order to remove debris that accumulates on the exhaust grill when the debris ejector is vertically displaced relative to the exhaust grill.

BRIEF DESCRIPTION OF THE DRAWING(S)

DETAILED DESCRIPTION OF THE INVENTION

The invention relates to debris disposal in surface cleaning apparatus, such as, but not limited to, vacuum cleaners, steam cleaners, extraction cleaners, or combinations thereof.

Figure 1:
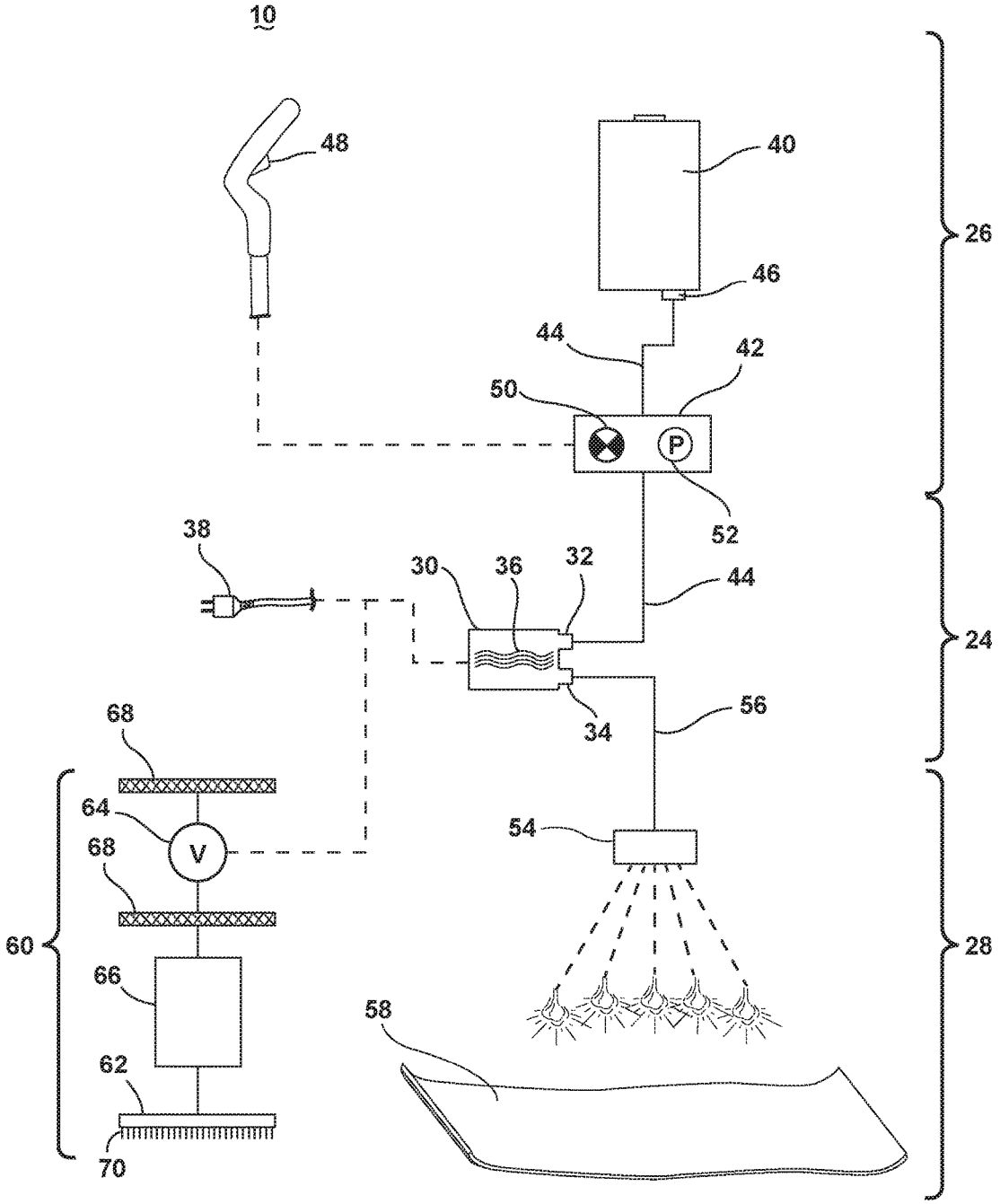
FIG. 1 is a schematic view of a surface cleaning apparatus.

FIG. 1 is a schematic view of various functional systems of a surface cleaning apparatus 10 in the form of a steam/vacuum cleaner according to a first embodiment of the invention. While referred to herein as a steam/vacuum cleaner, some aspects of the apparatus can alternatively be configured as a vacuum cleaner without steam capability, a hand-held device, or as an apparatus having a hand-held accessory tool connected to a canister or other portable device by a hose. Additionally, the surface cleaning apparatus can be configured to have additional capability, including scrubbing, sweeping, and/or extraction capability.

As used herein, the term "steam" includes a liquid, such as but not limited to water or solutions containing water (like water mixed with a cleaning chemistry, fragrance, etc.), converted to a gas or vapor phase. The liquid can be boiled or otherwise converted to the gas or vapor phase by heating or mechanical action like nebulizing. The steam can be invisible to the naked eye, in the form of a visible mist formed when the gas or vapor condenses in air, or combinations thereof.

The surface cleaning apparatus 10 includes a steam generation system 24 for producing steam from liquid, a liquid distribution system 26 for storing liquid and delivering the liquid to the steam generation system 24, a steam delivery system 28 for delivering steam to a surface to be cleaned, and a vacuum collection system 60 for creating a partial vacuum to suck up liquid and debris (which may include dirt, dust, hair, and other debris) from a surface to be cleaned and collecting the debris from a working airstream for later disposal.

The steam generation system 24 can include a steam generator 30 for producing steam from liquid. The steam generator 30 can include an inlet 32 and an outlet 34, and a heater 36 between the inlet 32 and outlet 34 for boiling the liquid. Some non-limiting examples of steam generators 30 include, but are not limited to, a flash heater, a boiler, an immersion heater, and a flow-through steam generator. The steam generator 30 can be electrically coupled to a power source 38, such as a battery or by a power cord plugged into a household electrical outlet.

The liquid distribution system 26 can include at least one supply tank 40 for storing a supply of liquid. The liquid can comprise one or more of any suitable cleaning liquids, including, but not limited to, water, compositions, concentrated detergent, diluted detergent, etc., and mixtures thereof. For example, the liquid can comprise a mixture of water and concentrated detergent. The liquid distribution system 26 can further include multiple supply tanks, such as one tank containing water and another tank containing a cleaning agent.

The liquid distribution system 26 can comprise a flow controller 42 for controlling the flow of liquid through a fluid conduit 44 coupled between an outlet port 46 of the supply tank 40 and the inlet 32 of the steam generator 30. An actuator 48, such as a trigger, can be provided to actuate the flow controller 42 and dispense liquid to the steam generator 30.

In one configuration, the liquid distribution system 26 can comprise a gravity-feed system and the flow controller 42 can comprise a valve 50, whereby when valve 50 is open, liquid will flow under the force of gravity, through the fluid conduit 44, to the steam generator 30. The actuator 48 can be operably coupled to the valve 50 such that pressing the actuator 48 will open the valve 50. The valve 50 can be mechanically actuated, such as by providing a push rod with one end coupled to the actuator 48 and another end in register with the valve 50, such that pressing the actuator 48 forces the push rod to open the valve 50. Alternatively, the valve 50 can be electrically actuated, such as by providing an electrical switch between the valve 50 and the power source 38 that is selectively closed when the actuator 48 is actuated, thereby powering the valve 50 to move to an open position.

In another configuration, the flow controller 42 can comprise a pump 52 that distributes liquid from the supply tank 40 to the steam generator 30. The actuator 48 can be operably coupled to the pump 52 such that pressing the actuator 48 will activate the pump 52. The pump 52 can be electrically actuated, such as by providing an electrical switch between the pump 52 and the power source 38 that is selectively closed when the actuator 48 is actuated, thereby activating the pump 52.

The steam delivery system 28 can include at least one steam outlet 54 for delivering steam to the surface to be cleaned, and a fluid conduit 56 coupled between an outlet 34 of the steam generator 30 and the at least one steam outlet 54. The at least one steam outlet 54 can comprise any structure, such as a perforated manifold or at least one nozzle; multiple steam outlets can also be provided. In use, the generated steam exits the outlet 34 of the steam generator 30 by pressure generated within the steam generator 30 and, optionally, by pressure generated by the pump 52. The steam flows through the fluid conduit 56, and out of the at least one steam outlet 54.

A cleaning pad 58 can be removably attached over the steam outlet 54 to the surface cleaning apparatus 10. In use, the cleaning pad 58 is saturated by the steam from the steam outlet 54, and the damp cleaning pad 58 is wiped across the surface to be cleaned to remove debris present on the surface. The cleaning pad 58 can be provided with features that enhance the scrubbing action on the surface to be cleaned to help loosen debris on the surface. The cleaning pad 58 can be disposable or reusable, and can further be provided with a cleaning agent or composition that is delivered to the surface to be cleaned along with the steam. For example, the cleaning pad 58 can comprise disposable sheets that are pre-moistened with a cleaning agent. The cleaning agent can be configured to interact with the steam, such as having at least one component that is activated or deactivated by the temperature and/or moisture of the steam. In one example, the temperature and/or moisture of the steam can act to release the cleaning agent from the cleaning pad 58.

The vacuum collection system 60 can include a suction nozzle 62, a suction source 64 in fluid communication with the suction nozzle 62 for generating a working airstream, and a separating and collection assembly 66 for separating and collecting debris from the working airstream for later disposal. Some examples of separating and collection assemblies 66 include, but are not limited to, a cyclone separator, a centrifugal separator, or a bulk separator. The collection assembly 66 can further be configured to separate liquid from the working air; however, as described below most or all of the liquid is separated from the working airstream prior to entering the collection assembly 66, and so any remaining liquid would be imperceptible and would not require any special features directed to separating and collecting liquid. As perceived by a user of the surface cleaning apparatus 10, the separating and collection assembly 66 separates and collects only dry debris.

The suction source 64, such as a motor/fan assembly, is provided in fluid communication with the separating and collection assembly 66, and can be positioned downstream or upstream of the separating and collection assembly. The suction source 64 can be electrically coupled to the power source 38. An electrical switch between the suction source 64 and the power source 38 can be selectively closed by the user upon pressing a power button (not shown), thereby activating the suction source 64.

The vacuum collection system 60 can also be provided with one or more additional filters 68 upstream or downstream of the separating and collection assembly 66 or the suction source 64. Optionally, an agitator 70 can be provided adjacent to the suction nozzle 62 for agitating debris on the surface to be cleaned so that the debris is more easily ingested into the suction nozzle 62. Some examples of agitators 70 include, but are not limited to, a rotatable brushroll, dual rotating brushrolls, or a stationary brush.

The surface cleaning apparatus 10 shown in FIG. 1 can be used to effectively remove debris (which may include dirt, dust, hair, and other debris) from the surface to be cleaned in accordance with the following method. The sequence of steps discussed is for illustrative purposes only and is not meant to limit the method in any way as it is understood that the steps may proceed in a different logical order, additional or intervening steps may be included, or described steps may be divided into multiple steps, without detracting from the invention.

To perform steam cleaning, the cleaning pad 58 is attached to the surface cleaning apparatus 10, over the steam outlet 54, the supply tank 40 is filled with liquid, and the steam generator 30 is coupled to the power source 38. Upon actuation of the actuator 48, liquid flows to the steam generator 30 and is heated to its boiling point to produce steam. The steam exits the steam outlet 54 and passes through the cleaning pad 58. As steam passes through the cleaning pad 58, a portion of the steam may return to liquid form before reaching the floor surface. The steam delivered to the floor surface can sanitize the surface when exposed for a predetermined amount of time before returning to liquid form. As the damp cleaning pad 58 is wiped over the surface to be cleaned, debris is loosened or solubilized, and excess liquid, dirt and debris on the surface are absorbed by the cleaning pad 58.

To perform vacuum cleaning, the suction source 64 is coupled to the power source 38. The suction source 64 draws in debris-laden air through the suction nozzle 62 and into the separating and collection assembly 66 where the debris is substantially separated from the working air. The air flow then passes the suction source 64, and optionally through any additional filters 68, prior to being exhausted from the surface cleaning apparatus 10. The separating and collection assembly 66 can be periodically emptied of debris. Likewise, the optional filters 68 can periodically be cleaned or replaced. The suction source 64 may also draw in liquid through the suction nozzle 62 and most or all of the liquid is separated from the working airstream prior to entering the collection assembly 66.

In some cases, the debris (which may include dirt, dust, hair, and other debris) may not easily empty from the collection assembly 66. In accordance with one aspect of the invention, the separating and collection assembly 66 can be provided with a debris ejector that applies force to accumulated debris in order to eject it from the collection assembly 66.

Figure 2:
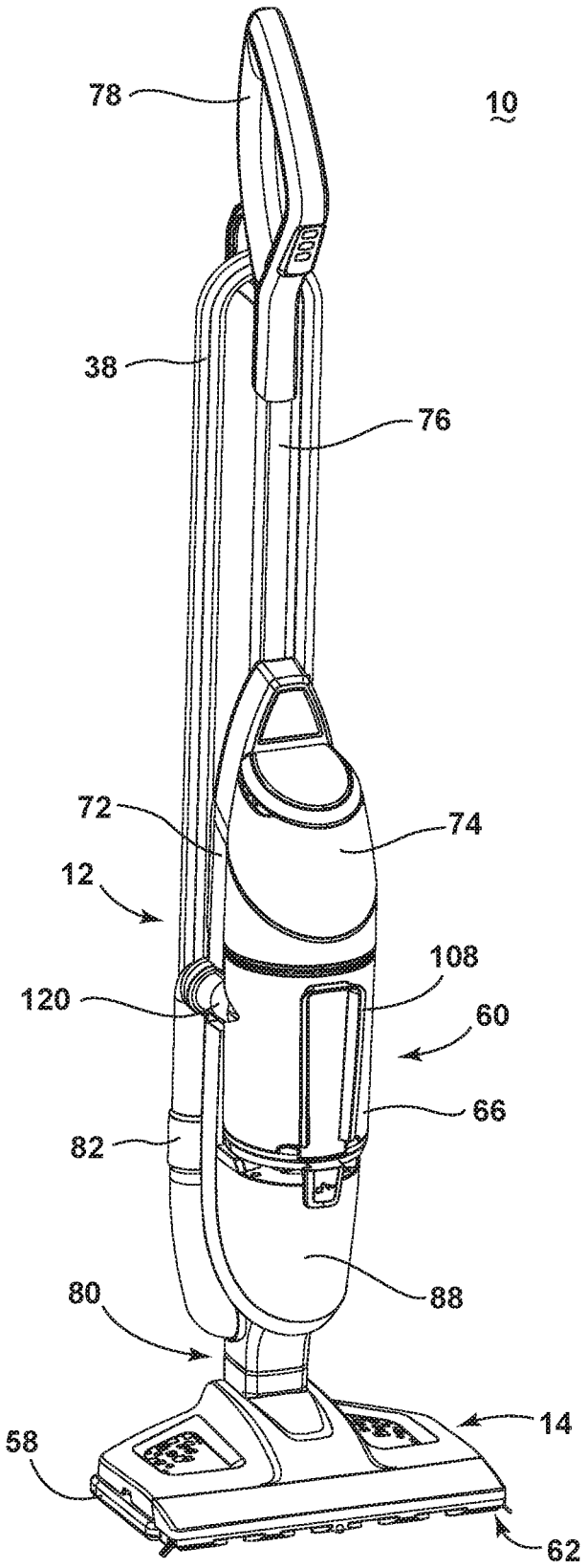
FIG. 2 is a front perspective view of a surface cleaning apparatus according to a first embodiment of the invention.

FIG. 2 is a front perspective view of a surface cleaning apparatus 10 which embodies the various functional systems according to the first embodiment of the invention. For purposes of description related to the figures, the terms "upper," "lower," "right," "left," "rear," "front," "vertical," "horizontal," "inner," "outer," and derivatives thereof shall relate to the invention as oriented in FIG. 1 from the perspective of a user behind the surface cleaning apparatus 10, which defines the rear of the surface cleaning apparatus 10. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The surface cleaning apparatus 10 comprises an upper housing 12 mounted to a lower cleaning foot 14 which is adapted to be moved across a surface to be cleaned. The housing 12 and the foot 14 may each support one or more components of the various functional systems discussed with respect to FIG. 1. The upper housing 12 generally comprises a main support section 72 with the separating and collection assembly 66 on a front portion thereof for separating and collecting debris, and optionally some amount of liquid, from a working airstream for later disposal. A motor cavity 74 is formed at an upper end of the support section 72, above the collection assembly 66, and contains the motor/fan assembly 64 (FIG. 1) positioned therein in fluid communication with the collection assembly 66. The foot 14 includes suction nozzle 62 that is in fluid communication with the suction source in the motor cavity 74, through the collection assembly 66.

An elongated handle 76 can project from the main support section 72, with a handle grip 78 provided on the end of the handle 76 to facilitate movement of the surface cleaning apparatus 10 by a user. The actuator 48 can be provided on the handle grip 78. A coupling joint 80 is formed at an opposite end of the housing 12 and moveably mounts the foot 14 to the housing 12. In the embodiment shown herein, the foot 14 can pivot up and down about one axis relative to the housing 12. The coupling joint 80 can alternatively comprise a universal joint, such that the foot 14 can pivot about at least two axes relative to the housing 12.

The foot 14 of the surface cleaning apparatus 10 can comprise a housing adapted to be moved over the surface to be cleaned and which can mount the cleaning pad 58, generally described with respect to FIG. 1. The housing includes a removable pad mounting plate 94 provided on the bottom of the foot 14 for mounting the cleaning pad 58 to the foot 14. The foot 14, at least one steam outlet 54 (FIG. 1), and the fluid conduit 56 coupled between the steam generator 30 (FIGS. 1 and 9) and the steam outlet 54 can extend at least partially through the coupling joint 80. At least a portion of the conduit 56 can be flexible to accommodate for the movement of the coupling joint 80.

The foot 14 can further include a working air conduit between the suction nozzle 62 and the collection assembly 66, which can extend though the coupling joint 80 and include an external conduit 82 connected between the coupling joint 80 and the collection assembly 66. The external conduit 82 can be a flexible hose or a rigid conduit. In addition to the cleaning pad 58, the foot 14 can be provided with one or more additional agitators, such as, but not limited to, a stationary or rotating brush positioned adjacent the suction nozzle 62, edge brushes, a squeegee, or combinations thereof.

Figure 3:
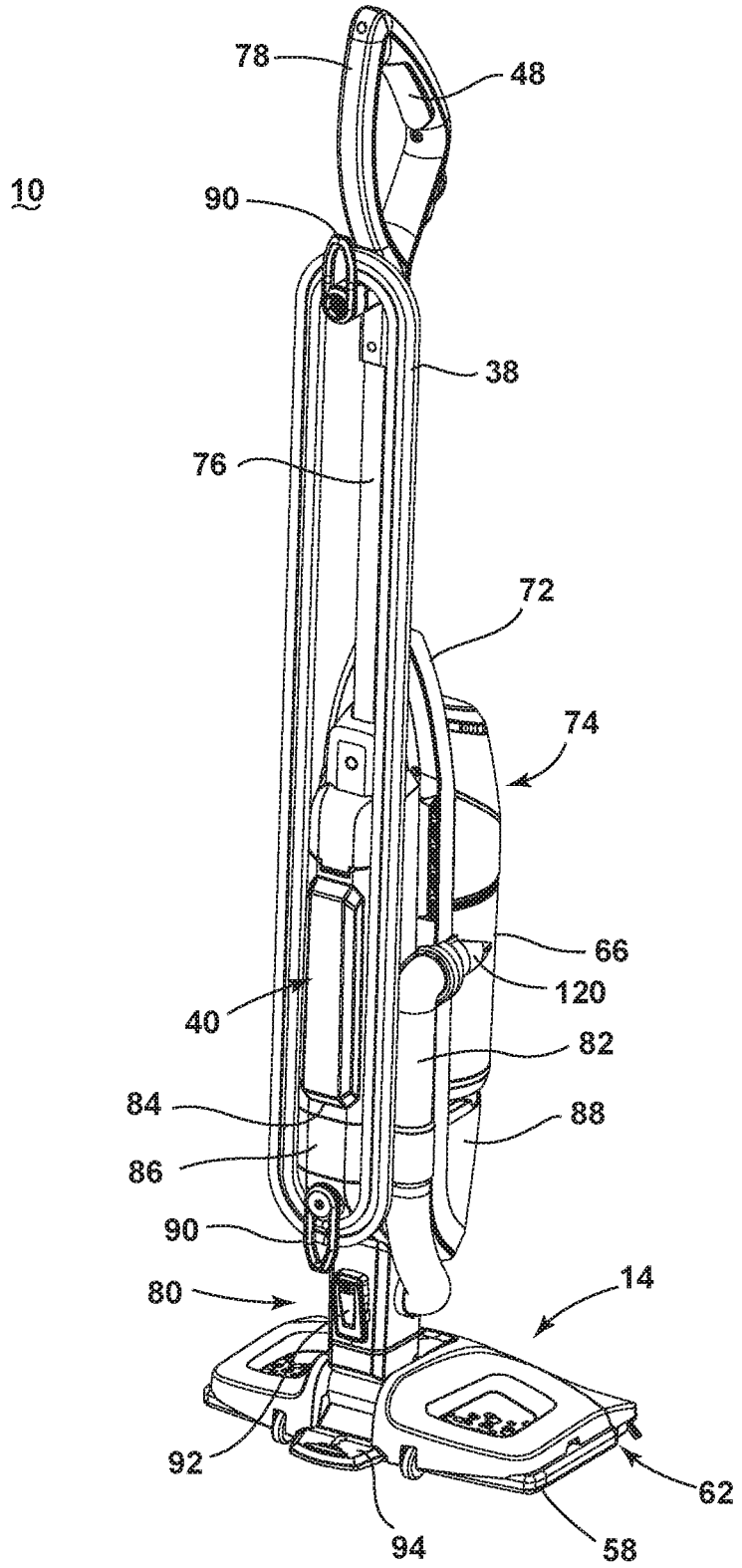
FIG. 3 is a rear perspective view of the surface cleaning apparatus from FIG. 2.

FIG. 3 is a rear perspective view of the surface cleaning apparatus 10. The supply tank 40 is supported on a rear portion of the main support section 72 for storing a supply of liquid. The housing 12 has a window 84 which allows the user to view the supply tank 40 and ascertain the level of liquid within the supply tank 40. A filter assembly 86 is supported on a rear portion of the main support section 72, below the supply tank 40, for filtering the liquid passing out of the supply tank 40. A heater cavity 88 is formed at a front, lower end of the support section, below the collection system, and contains the steam generator 30 (FIG. 1) positioned therein in fluid communication with the supply tank 40, through the filter assembly 86. Cord wraps 90 are provided on the rear portion of the upper housing 12, below and above the supply tank 40, and store the power cord 38 (shown in FIG. 1) which can plugged into a household electrical outlet to provide power to various components of the surface cleaning apparatus, such as but not limited to the steam generator 30 and the suction source 64. The foot 14 is detachably mounted to the upper housing 12 by a latch 92 provided on the rear of the coupling joint 80.

Figure 4:
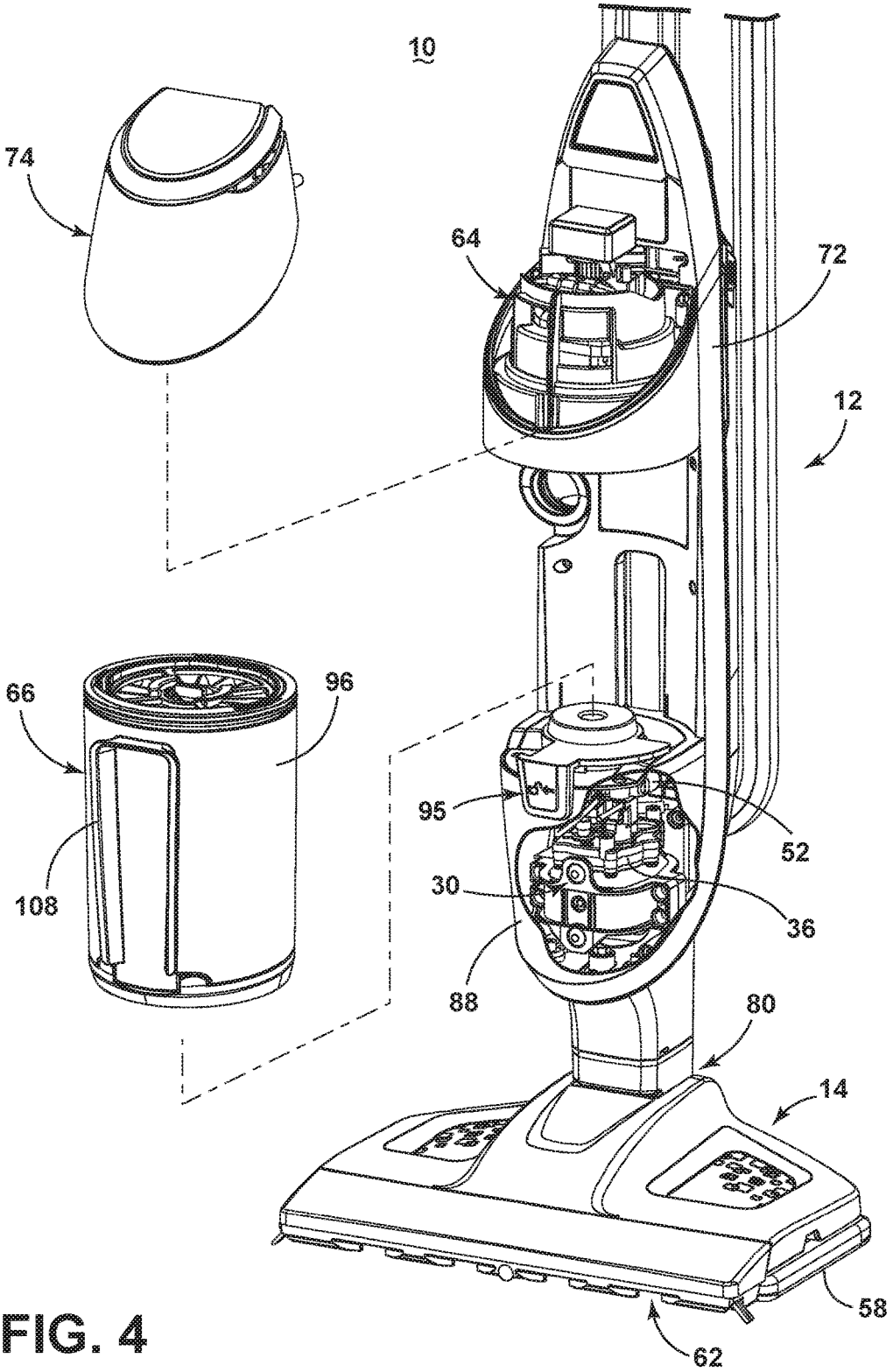
FIG. 4 is a partial exploded view of the surface cleaning apparatus from FIG. 2.

FIG. 4 is a partial exploded view of the surface cleaning apparatus 10. In this embodiment, the pump 52 is provided in the upper housing 12, in the heater cavity 88, to control the flow of liquid to the steam generator 30, also positioned in the heater cavity 88. When the pump 52 is activated, liquid flows through the pump 52 into the steam generator 30 to be heated by the heater 36.

The collection assembly 66 is shown as removed from the surface cleaning apparatus 10. A latch assembly 95 can be provided for selectively latching the collection assembly 66 to the main support section 72. The latch assembly 95 can cause the collection assembly 66 to move upwardly and downwardly with respect to the main support section 72. Upward movement of the collection assembly 66 effects the latching the collection assembly 66 to the surface cleaning apparatus 10 in a position to receive debris, while downward movement of the collection assembly 66 allows the collection assembly 66 to be selectively removed from the surface cleaning apparatus 10 to be emptied.

Figure 5:
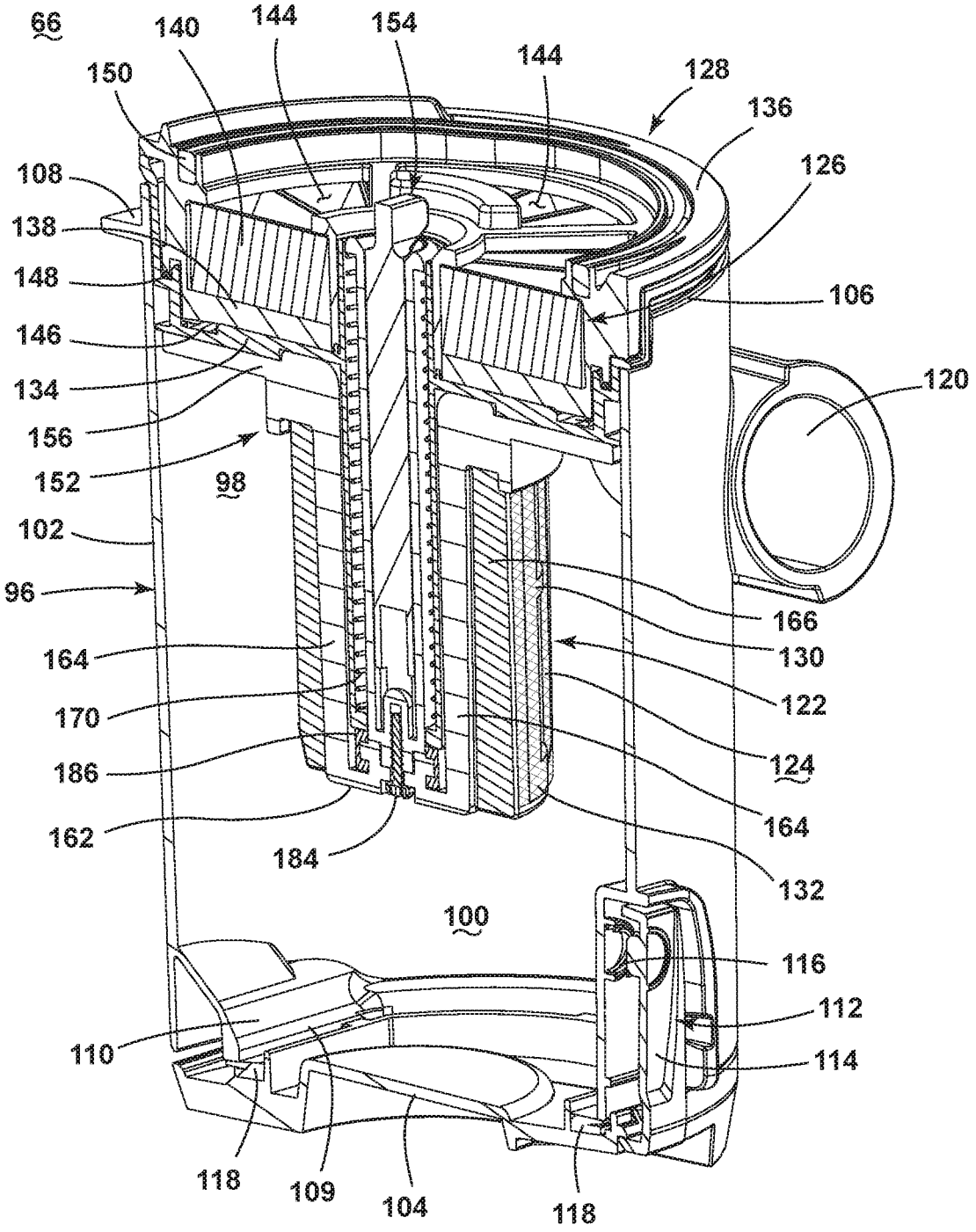
FIG. 5 is a cross-sectional, perspective view of a collection assembly for the surface cleaning apparatus from FIG. 2 having a debris ejector.

FIG. 5 is a cross-sectional, perspective view of the collection assembly 66. The collection assembly 66 comprises a housing 96 at least partially defining a single-stage cyclone chamber 98 for separating contaminants from a debris-containing working airstream and an integrally-formed debris collection chamber 100 which receives contaminants separated by the cyclone chamber 98. The housing 96 is common to the cyclone chamber 98 and the collection chamber 100, and includes a side wall 102, a bottom wall 104, and an open top defined by an upper edge 106 of the side wall 102. The side wall 102 is illustrated herein as being generally cylindrical in shape. A handle grip 108 attached to the housing 96 can be gripped by a user to facilitate removing collection assembly 66 from the upper housing 12.

The bottom wall 104 comprises a door or cover that can be selectively opened, such as to empty the contents of the collection chamber 100 through a bottom debris outlet 109 defined by a lower edge 106 of the side wall 102. The cover 104 is pivotally mounted to the side wall by a hinge 110. A door latch 112 is provided on the side wall 102, opposite the hinge 110, and can be actuated by a user to selectively release the cover 104 from engagement with the bottom of the side wall 102. The door latch 112 is illustrated herein as comprising a latch button 114 that is pivotally mounted to the side wall 102 and biased toward the closed position shown in FIG. 5 by a spring 116. By pressing the upper end of the latch button 114 toward the side wall 102, the lower end of the latch button 114 pivots away from the side wall 102 and releases the cover 104. An annular gasket 118 can be provided between the cover 104 and the bottom edge of the side wall 102 to seal the interface therebetween when the cover 104 is closed.

An air inlet to the cyclone chamber 98 can be at least partially defined by an inlet conduit 120. An air outlet from the cyclone chamber 98 can be at least partially defined by an exhaust grill 122 which guides working air out of the housing 96. The inlet conduit 120 is in fluid communication with the suction nozzle 62 (FIG. 4) and the exhaust grill 122 is in fluid communication with the suction source 64 (FIG. 4). The exhaust grill 122 is positioned in the center of the cyclone chamber 98 and can depend from a bottom wall of the cover assembly 128.

The exhaust grill 122 separates the cyclone chamber 98 from a passageway 124 leading to a pre-motor filter assembly 126 within a cover assembly 128 that is removably mounted to the upper edge 106 to partially close the open top. The exhaust grill 122 includes a generally cylindrical cage-like body 130 defining a plurality of openings which can be covered by a filtration media 132 that prevents at least some particles in the working airstream from entering the openings. Some non-limiting examples of the filtration media 132 is a mesh or screen, such as a nylon mesh or screen.

Figure 6:
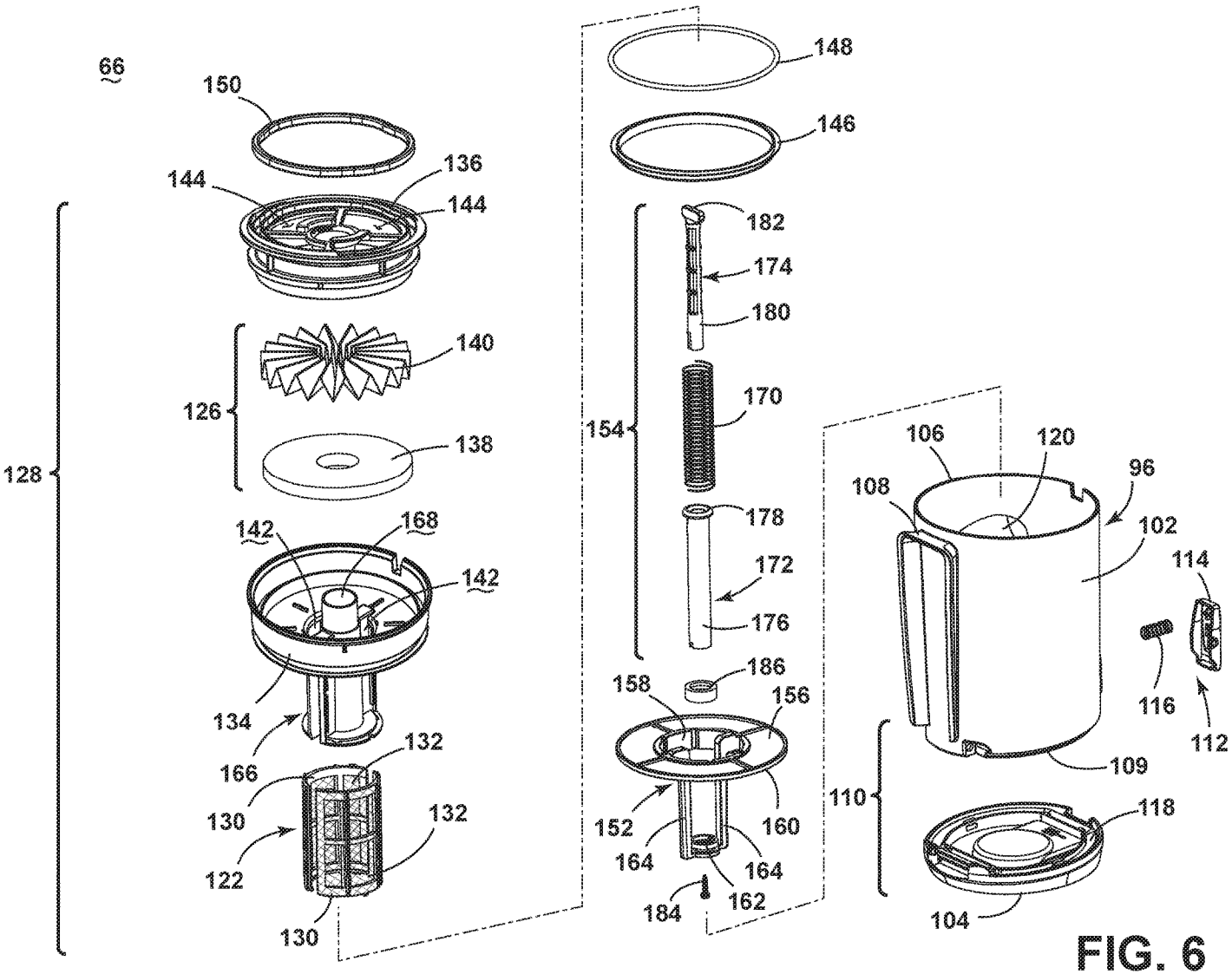
FIG. 6 is an exploded view of the collection assembly from FIG. 5.

FIG. 6 is an exploded view of the collection assembly 66. The cover assembly 128 can define a filter chamber for the pre-motor filter assembly 126 and includes a lower filter housing 134 and an upper filter cover 136 which can be mounted to the lower filter housing 134. The pre-motor filter assembly 126 can include one or more filters. In one non-limiting example, the pre-motor filter assembly 126 can comprise a sponge filter 138 and a pleated HEPA filter 140 arranged sequentially with respect to the direction of air flow. The lower filter housing 134 includes a central opening 142 allowing air to pass out of the exhaust grill 122 and into the sponge filter 138. The upper filter cover 136 can have a lattice-like frame with multiple openings 144 allowing air to pass out of the pre-motor filter assembly 126. After passing through the filter cover 136, working air can pass to the suction source 64 (see FIG. 4).

A first seal 146 and a second seal 148 are provided between the lower filter housing 134 and the upper filter cover 136 for providing fluid-tight interfaces therebetween. A third seal 150 can be provided on the top of the upper filter cover 136 for sealing the air path between the pre-motor filter assembly 126 and the suction source 64 when the separating and collection assembly 66 is latched on the main support section 72 (see FIG. 4).

The collection assembly 66 further includes a debris ejector 152 that is reciprocally moveable within the housing 96. The debris ejector 152 can eject debris through the debris outlet 109 of the housing 96 when the cover 104 is open. A retractable push rod 154 is selectively coupled to the debris ejector 152 to actuate the debris ejector 152. When debris ejection is not required, the push rod 154 can be retracted into the collection assembly 66.

The debris ejector 152 of the illustrated embodiment includes an ejector plate 156 configured to be removed vertically within the housing 96 by the push rod 154. The ejector plate 156 can be annular and includes an inner opening 158 that accommodates the exhaust grill 122 and an outer peripheral edge 160 that can extend to the side wall 102. The inner opening 158 can be sized such that the ejector plate 156 passes in close proximity to the exhaust grill in order to remove debris that accumulates on the mesh.

The debris ejector 152 can further include a push member 162 which engages with the push rod 154 to transfer the push force from the push rod 154 to the ejector plate 156. The push member 162 can be coupled with the ejector plate 156 by a connector, shown herein as two vertical links 164 extending between the push member 162 and the ejector plate 156 and supporting the push member 162 below the ejector plate 156.

In the illustrated embodiment, a stationary grill support 166 depends from the lower filter housing 134 to support the exhaust grill 122 within the housing 96 in a fixed position. The grill support 166 includes a central passage 168 to accommodate the push rod 154. The grill support 166 can further be split to allow for the passage of the vertical links 164 as the ejector plate 156 moves relative to the exhaust grill 122 and grill support 166.

The push rod 154 includes an outer member 172 and an inner member 174 that is collapsible or telescopingly received within the outer member 172 when the push rod 154 is retracted. The outer member 172 includes a generally cylindrical sleeve 176 defining a receiving space for the inner member 174 and having a flange 178 at its upper end. The inner member 174 includes a generally cylindrical shaft 180 sized to slide within the sleeve 176, with a handle 182 at its upper end. In the retracted position, the handle 182 can be at or below the top of the cover assembly 128 (see FIG. 5).

A spring 170 can be provided for biasing the debris ejector 152 upwardly within the housing 96. As illustrated, the spring 170 is positioned within the central passage 168 and between the grill support 166 and the flange 178 to bias the outer member 172, and therefore the entire debris ejector 152, upwardly within the housing 96, as shown in FIG. 5.

The push rod 154 can be retained in the collection assembly 66 during normal operation so that a user cannot inadvertently pull the push rod 154 out of the housing 96. In the illustrated example, the outer member 172 of the push rod 154 is fastened to, or otherwise fixed with, the push member 162 using a fastener in the form of a screw 184. Further, a seal 186 is provided between the push member 162 and the grill support 166 for providing a fluid-tight interface therebetween when the debris ejector 152 is in the uppermost position (see FIG. 5).

Figure 7C:
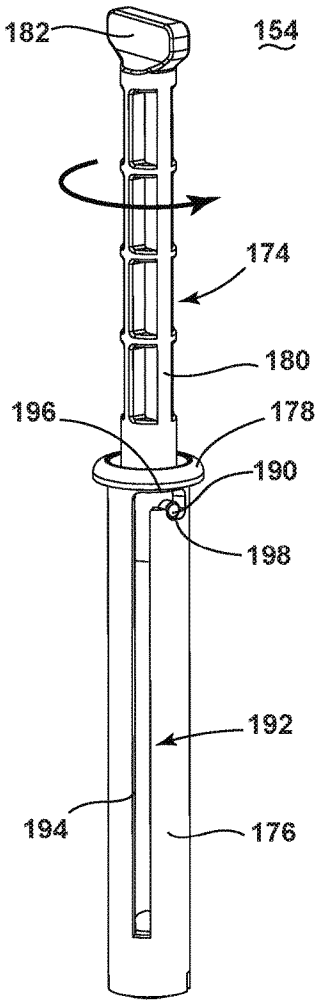
FIGS. 7A-7C are perspective views of a push rod for the debris ejector of the collection assembly from FIG. 5 showing the extension of the push rod.
Figure 7B:
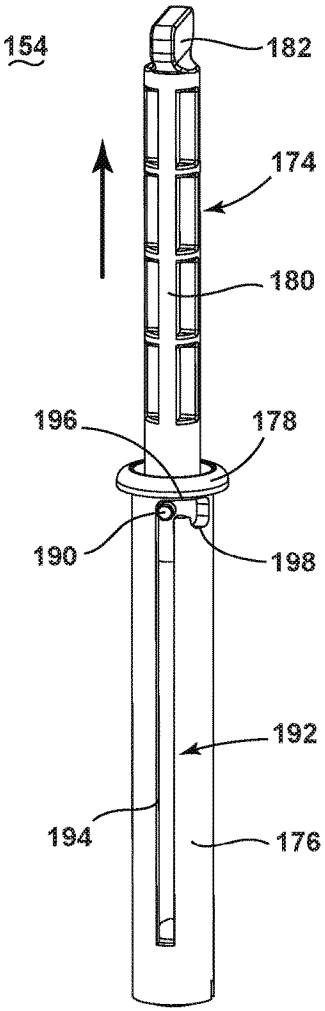
Figure 7A:
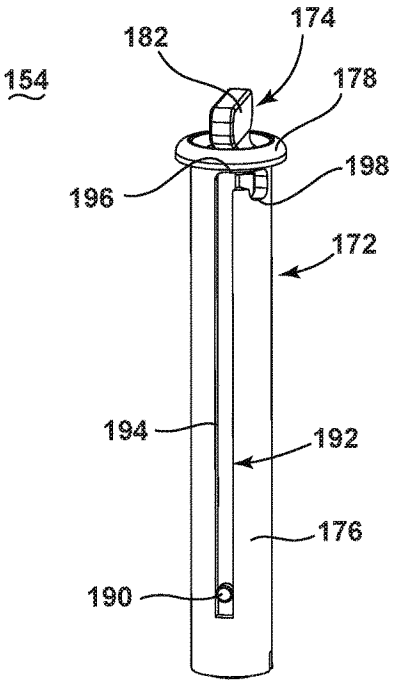

FIGS. 7A-7C are perspective views of the push rod 154 showing the extension of the push rod 154. The push rod 154 can further include a lockable coupling between the members 172, 174 for selectively locking the push rod 154 in the extended position. The lockable coupling can include a pin 190 projecting radially from the shaft 180 the inner member 174 that engages a slot 192 in the sleeve 176 of the outer member 172. The push rod 154 is configured so the inner member 174 moves relative to the outer member 172 between the positions illustrated in FIGS. 7A-7C via the sliding movement of the pin 190 in the slot 192. The movement of the pin 190 in the slot 192 also provides a locking mechanism for securing the members 172, 174 in the extended position. In an alternate configuration, the slot 192 can be formed in the shaft 180 of the inner member 174 and the pin 190 can be formed on the sleeve 176.

The slot 192 includes a longitudinal segment 194 and a radial segment 196 which extends radially from the upper end of the longitudinal segment 194 in a circumferential direction on the sleeve 176. Longitudinal movement of the inner member 174 relative to the outer member 172 is controlled by the longitudinal segment 194, and rotational movement of the inner member 174 relative to the outer member 172 is controlled by the radial segment 196. The slot 192 further includes an end segment 198 that extends downwardly from the end of the radial segment 196 opposite the longitudinal segment 194 to selectively secure the pin 190, thereby locking the push rod 154 in the extended position.

FIG. 7A shows the push rod 154 in the retracted position. To extend the push rod 154, a user can grip the handle 182 and pull upwardly on the inner member 174. The pin 190 slides within the longitudinal segment 194 of the slot 192 to guide the longitudinal extension of the inner member 174 relative to the outer member 172 to the position shown in FIG. 7B. Once the pin 190 reaches the top of the longitudinal segment 194, the inner member 174 can be rotated such that the pin 190 slides within the radial segment 196 of the slot 192 to guide the rotation of the inner member 174 within the outer member 172. The pin 190 can then drop into the end segment 198 of the slot 192 to lock the push rod 154 in the extended position shown in FIG. 7C. These steps can generally proceed in the opposite order to retract the push rod 154.

With reference to FIGS. 2-5, the surface cleaning apparatus 10 can be used to effectively remove liquid and debris (which may include dirt, dust, hair, and other debris) from the surface to be cleaned in accordance with the following method. The sequence of steps discussed is for illustrative purposes only and is not meant to limit the method in any way as it is understood that the steps may proceed in a different logical order, additional or intervening steps may be included, or described steps may proceed concurrently, or be divided into multiple steps, without detracting from the invention.

In operation, the surface cleaning apparatus 10 can be utilized in a vacuum only mode, a steam only mode, or a concurrent vacuum and steam mode. For vacuum cleaning, the suction source 64 is energized and draws liquid and debris-containing air from the suction nozzle 62 through a circuitous working air path which can trap and evaporate moisture before the working air enters the collection assembly 66, where the debris and any remaining liquid are separated from the working air. Although the collection assembly 66 can be configured to separate liquid from the working air, most or all of the liquid is separated from the working air prior to entering the collection assembly 66, and so any remaining liquid would be imperceptible. The working air, which may still contain some smaller or finer debris, then passes through the exhaust grill 122 which can separate out some additional debris. The working air, which may still contain some even smaller or finer debris, passes through the pre-motor filter assembly 126, where additional debris may be captured. The working air then exits the collection assembly 66 and passes through the suction source 64 before being exhausted from the surface cleaning apparatus 10. One or more additional filter assemblies may be positioned upstream or downstream of the suction source 64.

For steam cleaning, the cleaning pad 58 is attached to the foot 14, the supply tank 40 is filled with liquid, and the power cord 38 is plugged into a household electrical outlet. Upon pressing the actuator 48, the pump 52 is activated and liquid flows from the supply tank 40, through the filter assembly 86, to the steam generator 30. In the steam generator 30, liquid is heated to its boiling point to produce steam. The generated steam exits the steam generator 30 and guided downwardly to the foot 14 towards the surface to be cleaned. As steam passes through the cleaning pad 58, a portion of the steam may return to liquid form before reaching the floor surface. A portion of the steam delivered to the floor surface can also return to liquid form. As the damp cleaning pad 58 is wiped over the surface to be cleaned, at least some excess liquid and debris on the surface can absorbed by the cleaning pad 58. Liquid and debris can also be removed from the surface to be cleaned by operation of the vacuum mode.

Operating in the concurrent vacuum and steam mode, the steam generator 30 and suction source 64 operate concurrently such that steam delivery and suction pick-up occur at the same time, or at least partially overlap each other. With the surface cleaning apparatus 10, the collection assembly 66 remains perceptibly dry during and after concurrent operation of the steam generator 30 and suction source 64.

To dispose of collected debris and any remaining imperceptible amount of liquid, the collection assembly 66 is detached from the surface cleaning apparatus 10 using the latch assembly 95 (see FIG. 4). Using the latch 112, the cover 104 is opened under the force of gravity, and at least some accumulated debris can fall from the collection chamber 100 through the debris outlet 109 of the housing 96. In some cases, at least some of the some accumulated debris may remain in the housing 96. The debris ejector 152 can then be used to eject any remaining debris from the housing 96.

Figure 8:
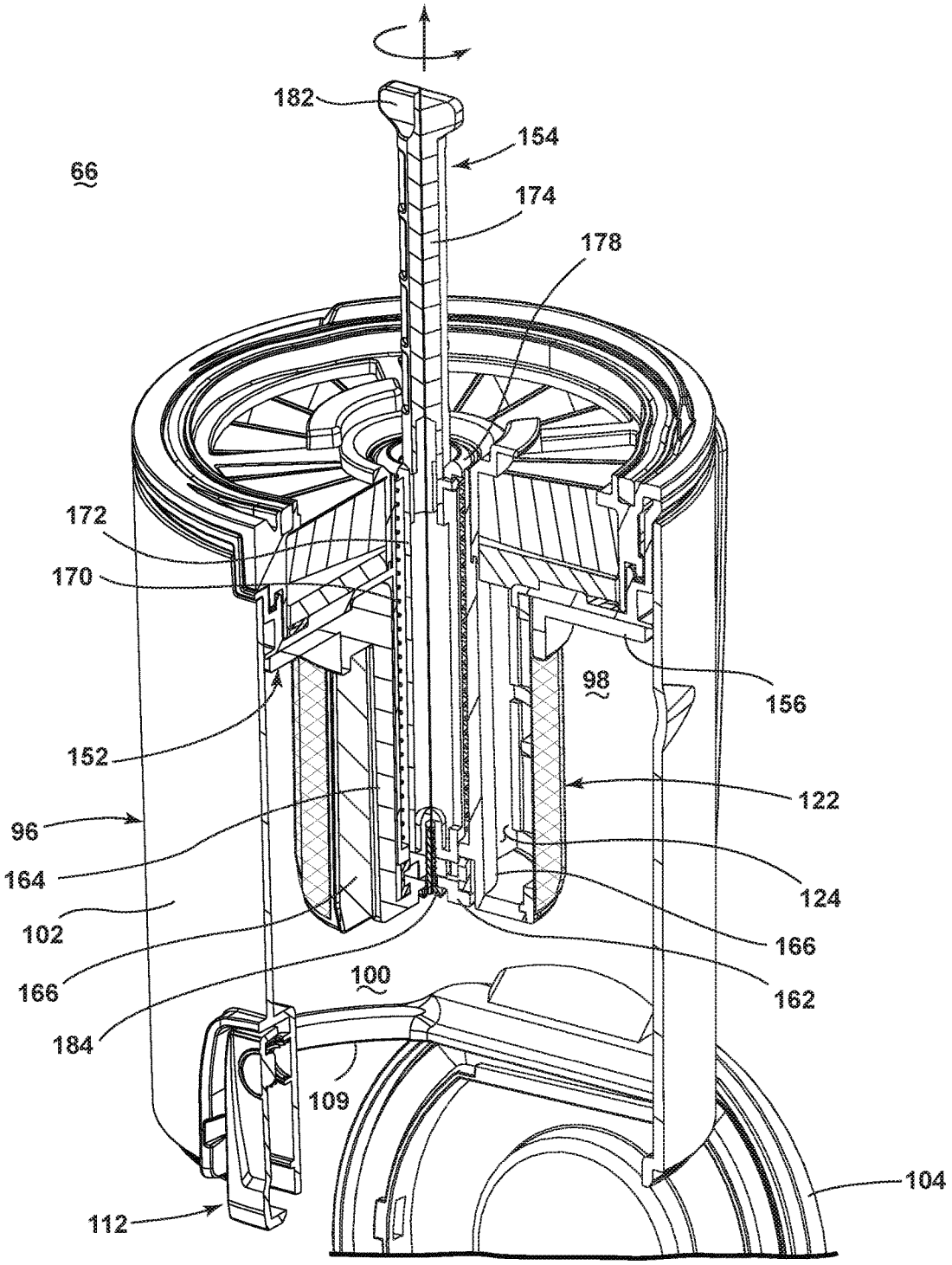
FIGS. 8-9 are quarter-section views of the collection assembly from FIG. 5 showing the operation of the debris ejector.
Figure 9:
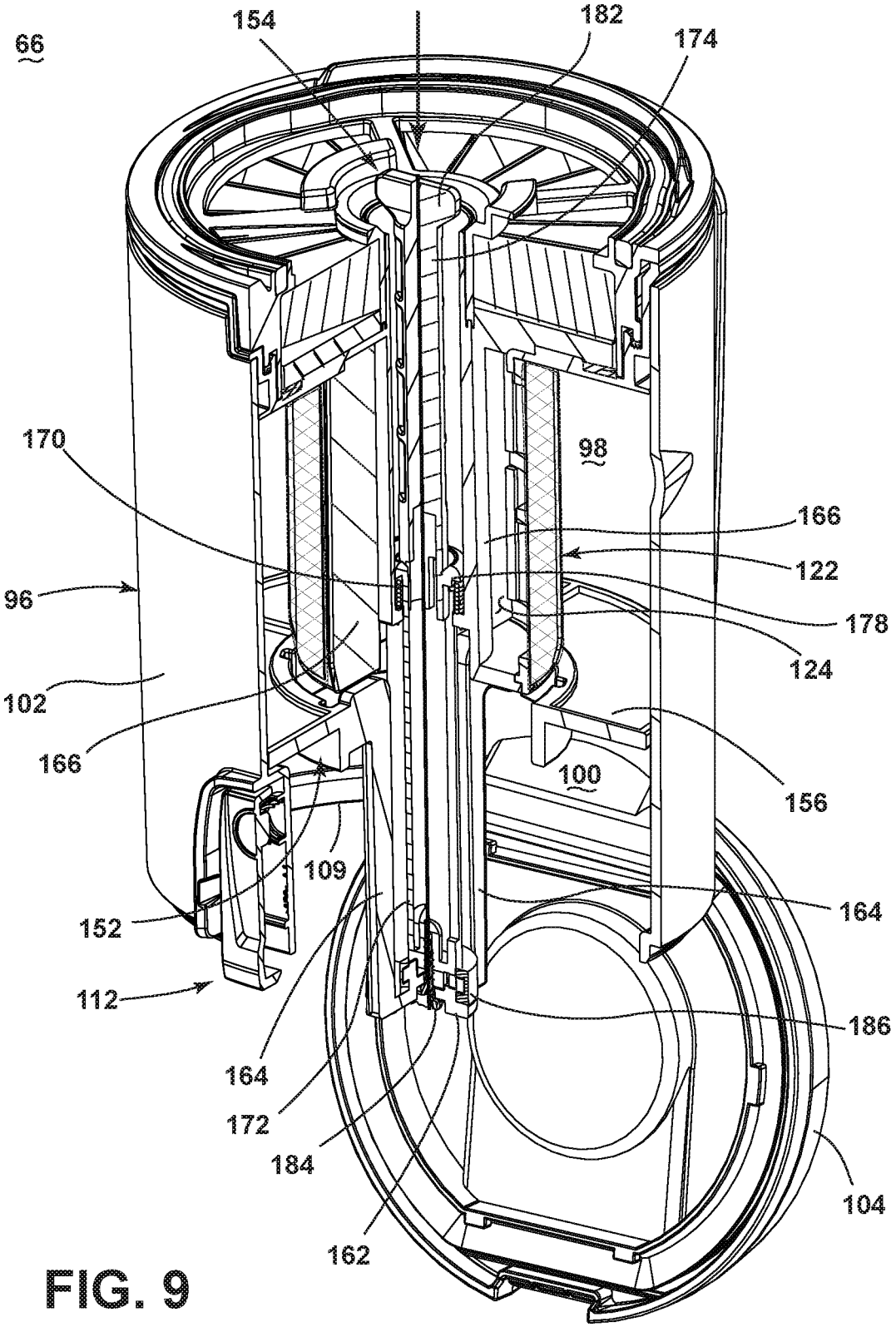

FIGS. 8-9 are quarter-section views of the collection assembly 66 from FIG. 5 showing the operation of the debris ejector 152. The retractable push rod 154 is moveable between a retracted position (shown in FIG. 5) in which the push rod 154 lies within the housing 96 and an extended position (shown in FIG. 8) in which the push rod 154 extends from the housing 96 and is operably coupled to the debris ejector 152. The extension of the push rod 154 can proceed as described above with respect to FIGS. 7A-7C. When the push rod 154 is in the extended position, downward pressure on the push rod 154 displaces the debris ejector 152 relative to the debris outlet 109, as shown in FIG. 9. The ejector plate 156 moves downwardly within the housing 96 and pushes any remaining debris out of the debris outlet 109. As the ejector plate 156 moves, it may scrape the exterior of the exhaust grill 122 and remove debris that accumulates on the grill 122. In its lowermost position, shown in FIG. 9, a portion of the debris ejector 152 may project through the debris outlet 109; as such the cover 104 cannot be closed. However, upon release of the push rod 154, the spring 170 biases the debris ejector 152 upwardly within the housing 96 to the position shown in FIG. 8. The user can then retract the push rod 154 back into the housing 96 as previously described, close the cover 104, and replace the collection assembly 66 on the surface cleaning apparatus 10.

While the surface cleaning apparatus 10 is shown in FIGS. 2-9 as a steam/vacuum cleaner, some aspects of the debris ejector 152 can alternatively be used with a vacuum cleaner without steam capability, including upright vacuum cleaners, hand-held vacuum cleaners, portable vacuum cleaners, or canister vacuum cleaners. Further, the debris ejector 152 can be used with virtually any collection assembly having a bottom dirt outlet, and is not limited to cyclonic collection assemblies.

The various embodiments of surface cleaning apparatus and other devices related to the invention disclosed herein provide improved debris disposal. One advantage that may be realized in the practice of some embodiments of the described apparatus is that accumulated debris can be forcefully ejected from the collection assembly. Prior collection assemblies having a bottom empty design rely on gravity alone to dispose of debris through the bottom dirt outlet. However, in some cases debris may become stuck within the assembly, requiring a user to remove it by hand or by shaking or tapping the assembly in order to remove it. Embodiments of the present invention provide a debris ejector that applies force to accumulated debris in order to eject the debris through the bottom dirt outlet. In a further advantage of some embodiments of the described invention, a telescoping push rod can be used to actuate the debris ejector; the compact design of the push rod conserves space within the collection assembly and allows the collection assembly to be easily mounted to the surface cleaning apparatus.

While the invention has been specifically described in connection with certain specific embodiments thereof, it is to be understood that this is by way of illustration and not of limitation. Reasonable variation and modification are possible with the scope of the foregoing disclosure and drawings without departing from the spirit of the invention which, is defined in the appended claims. Hence, specific dimensions and other physical characteristics relating to the embodiments disclosed herein are not to be considered as limiting, unless the claims expressly state otherwise.

What is claimed is:

1. A surface cleaning apparatus, comprising:
- a suction nozzle;
- a suction source fluidly connected to the suction nozzle; and
- a separating and collection assembly in fluid communication with the suction nozzle and comprising:
  - a housing defining a collection chamber adapted to receive debris and having a debris outlet at a lower end thereof;
  - a door at the lower end of the housing selectively closing the debris outlet;
  - an exhaust grill within the housing;
  - a debris ejector reciprocally moveable within the housing; and
  - a push rod operably coupled to the debris ejector and biased upwardly relative to the housing by a spring;
  - wherein the debris ejector comprises an ejector plate adapted for vertical displacement relative to the exhaust grill; and
  - wherein the ejector plate comprises an opening accommodating the exhaust grill and sized such that the ejector plate passes in proximity to the exhaust grill in order to remove debris that accumulates on the exhaust grill when the debris ejector is vertically displaced relative to the exhaust grill.

2. The surface cleaning apparatus of claim 1, wherein the housing comprises a side wall having a lower edge defining the debris outlet, and the ejector plate comprises an outer peripheral edge that extends to the side wall.

3. The surface cleaning apparatus of claim 1, wherein the ejector plate is further adapted for vertical displacement relative to the debris outlet to eject debris through the debris outlet when the door is open.

4. The surface cleaning apparatus of claim 1, wherein the debris ejector further comprises a push member which engages with the push rod to transfer a push force from the push rod to the ejector plate.

5. The surface cleaning apparatus of claim 1, wherein the exhaust grill is at an upper end of the housing.

6. The surface cleaning apparatus of claim 1, wherein the exhaust grill is stationary within the housing and the ejector plate is adapted for vertical movement relative to the stationary exhaust grill.

7. The surface cleaning apparatus of claim 1, wherein the separating and collection assembly further comprises a cyclone chamber, wherein the collection chamber receives debris separated in the cyclone chamber.

8. The surface cleaning apparatus of claim 7, wherein the housing further defines the cyclone chamber, and the cyclone chamber and the collection chamber are removable from the surface cleaning apparatus as a single unit.

9. The surface cleaning apparatus of claim 1, and further comprising a hinge coupling the door to the housing.

10. The surface cleaning apparatus of claim 1, and further comprising a rotatable brushroll adjacent to the suction nozzle.

11. The surface cleaning apparatus of claim 1, and further comprising a working air conduit between the suction nozzle and the separating and collection assembly, the working air conduit including a flexible hose.

12. The surface cleaning apparatus of claim 1, and further comprising a latch assembly selectively latching the separating and collection assembly to a housing of the surface cleaning apparatus.

13. The surface cleaning apparatus of claim 1, wherein the housing comprises:
- a side wall with an upper edge and a lower edge; and
- an open top defined by the upper edge of the side wall;
- wherein the lower edge defines the debris outlet and the door is pivotally mounted to the side wall.

14. The surface cleaning apparatus of claim 13, and further comprising:
- a hinge coupling the door to the side wall; and
- a door latch provided on the side wall opposite the hinge and releasably holding the door in engagement with the lower edge of the side wall.

15. The surface cleaning apparatus of claim 13, wherein the open top is partially closed by a cover assembly.

16. The surface cleaning apparatus of claim 15, wherein the exhaust grill depends from the cover assembly.

17. The surface cleaning apparatus of claim 15, wherein the cover assembly comprises a filter.

18. The surface cleaning apparatus of claim 17, wherein the push rod comprises a retractable push rod.

19. The surface cleaning apparatus of claim 1, wherein the surface cleaning apparatus is one of an upright vacuum cleaner, a hand-held vacuum cleaner, a portable vacuum cleaner, a canister vacuum cleaner, a steam cleaner, an extraction cleaner, or a steam/vacuum cleaner.

20. The surface cleaning apparatus of claim 1, and further comprising:
- a supply tank;
- a steam generator in fluid communication with the supply tank; and
- a steam outlet in fluid communication with the steam generator.

* * * * *